US006221125B1

(12) United States Patent
Soda et al.

(10) Patent No.: US 6,221,125 B1
(45) Date of Patent: Apr. 24, 2001

(54) WATER-ATOMIZED SPHERICAL METAL POWDERS AND METHOD FOR PRODUCING THE SAME

(75) Inventors: Yuji Soda, Ichihara; Yukio Tokuyama, Chiba; Hiroshi Usui, Kashihara, all of (JP)

(73) Assignee: Mitsubishi Steel Mfg. Co., Ltd., Tokyo (JP)

( * ) Notice: Subject to any disclaimer, the term of this patent is extended or adjusted under 35 U.S.C. 154(b) by 1146 days.

(21) Appl. No.: 08/542,399

(22) Filed: Oct. 12, 1995

Related U.S. Application Data

(63) Continuation-in-part of application No. 08/263,776, filed on Jun. 22, 1994, now abandoned.

(51) Int. Cl.[7] ..... B22F 1/00
(52) U.S. Cl. ..... 75/342; 75/255
(58) Field of Search ..... 75/342, 255

(56) References Cited

U.S. PATENT DOCUMENTS 4,209,326 * 6/1980 Klein et al. ..... 75/342
5,006,164 * 4/1991 Kiyota ..... 75/255

* cited by examiner

*Primary Examiner*—Scott Kastler
(74) *Attorney, Agent, or Firm*—Flynn, Thiel, Boutell & Tanis, P.C.

(57) ABSTRACT

A water-atomized metal powder having a spherical particle shape, an average particle size of 25 μm or less and a tap density ratio of 50–60%. The spherical powder is produced by forming non-spherical metal particles, which have been produced from molten metal by water-atomization, into spherical particles using a high speed gas current which causes high speed collisions to occur between said particles and between said particles and a collision body. The thus obtained spherical metal powder is particularly suitable for injection molding since and, by using the powder, the blending proportion of organic binder used in injection molding can be reduced and high strength debound bodies can be obtained.

5 Claims, 1 Drawing Sheet

WATER-ATOMIZED SPHERICAL METAL POWDERS AND METHOD FOR PRODUCING THE SAME

CROSS REFERENCE TO RELATED APPLICATION

The present application is a continuation-in-part of U.S. Ser. No. 08/263,766, filed Jun. 22, 1994, now abandoned.

BACKGROUND OF THE INVENTION

1. Field of the Invention

This invention relates to spherical metal powders suitable for use in metal injection molding, and to a method for producing such powders.

2. Description of the Prior Art

Of the powdered raw materials used for metal injection molding, powdered alloys are produced by water-atomization or gas atomization.

When a melt of metal or alloy is formed into particles by water in the process of water atomization, the melt is cooled very rapidly so that the particles formed have a non-spherical shape. Their tap density ratio is therefore only 40–46%, and they cannot be used as a raw material for injection molding unless a large amount of an organic binder is blended with them. However, when the blending proportion of an organic binder is high, a long debinding time is needed and problems such as blistering or distortion arise with considerable frequency during the debinding process.

On the other hand, in the case of a gas-atomized powder, the particles produced are perfect spheres so that their tap density ratio is of the order of 60% and a sufficient injection moldability can be ensured, even with a low blending proportion of an organic binder. However, in this case, there is no interaction at all between particles after the debinding process. Thus, the strength of the debound body is reduced. Further, the gas-atomized powder is also more costly to produce than the water-atomized powder.

SUMMARY OF THE INVENTION

Accordingly, an object of the present invention to simultaneously overcome the disadvantages associated with a high blending proportion of organic binder required for the injection molding of non-spherical water-atomized particles having a tap density ratio as low as 40–46% and the problems caused due to the poor strength of molded debound bodies of gas-atomized particles. More specifically, an object of the present invention is to modify the non-spherical particles of a water-atomized powder into spherical particles so that the particle shape of the water-atomized powder becomes close to the particle shape of the gas-atomized powder and the blending proportion of organic binder can therefore be reduced compared to the proportion normally required for a conventional water-atomized powder in the injection molding process. A further object of the present invention is to provide debound bodies having a higher strength than in the case of the gas-atomized powder. As a result, there is provided a water-atomized spherical metal powder which ameliorates all the problems encountered in both types of atomized powders, i.e., water-atomized powder and gas-atomized powder.

Accordingly, this invention provides a water-atomized pherical metal powder having a spherical particle shape, an average particle size of 25 $\mu$m or less and a tap density ratio of 50–60%.

The present invention further provides a method for producing the above-mentioned water-atomized spherical metal powder wherein metal particles of non-spherical shape produced from molten metal by water-atomization are formed into particles of spherical shape by means of a high speed gas stream which causes high speed collisions to occur between the particles and between the particles and a collision target.

DETAILED DESCRIPTION OF THE PREFERRED EMBODIMENTS

Figure 1:
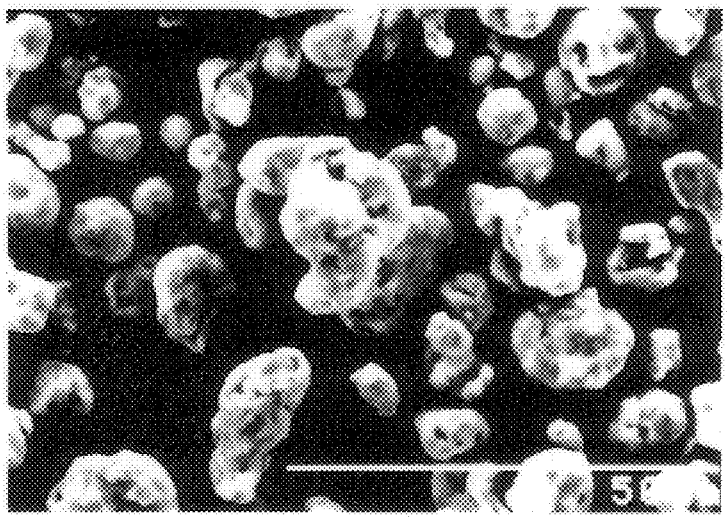
FIG. 1 is a scanning electron micrograph of a water-atomized powder which has been subjected to the high-speed gas treatment using a collision target according to the present invention.

The metal used in this invention may be any metal normally used to produce powders for injection molding such as stainless steel AISI 316, Permendur, high speed steel M2 or the like. The high speed gas stream used for causing collisions to occur between metal particles and between metal particles and a collision target may be any gas flowing at a speed of 200 m/sec or more, such as air, or an inert gas, such as Ar, $N_2$, etc. Due to collisions between the particles and collisions between the particles and a collision target by the high speed gas stream, the particles obtained by water-atomization undergo strong impacts and the surface projections on the particles are smoothed so that the particles overall become more spherical. However, the average particle size of the spherical metal powder thus obtained should not exceed 25 $\mu$m, otherwise the powder is no longer suitable for injection molding.

EXAMPLES 100 kg of powder prepared from a melt of each steel, shown in Table 1, by water-atomization was introduced in a jet mill (Nippon Pneumatic MFG., CO., Ltd., Type I-10), and treated by flowing an air stream at a flowing rate of 600 m/sec for 60 min. The average particle size of the treated powder was 10 pm. Table 1 shows the tap densities before and after the treatment for each water-atomized powder.

Table 1 shows the tap densities of the water-atomized powders before the high-speed gas treatment and the water-atomized powders after the high-speed gas treatment with or without using a collision target in the mill. The collision target was disposed in the direction of the flow of the high-speed gas and in the vicinity of the opening of a nozzle from which the atomized particles were expelled and brought to collide against the collision target by the high-speed gas.

TABLE 1

| | | Tap density | Tap density after treatment | |
|---|---|---|---|---|
| Sample | True density g/cm$^3$ | before treatment g/cm$^3$ (Tap density ratio) | without collision target g/cm$^3$ (Tap density ratio) | with collision target g/cm$^3$ (Tap density ratio) |
| Stainless steel AISI 316 | 8.03 | 3.6 (44.8%) | 3.8 (47.3%) | 4.3 (53.5%) |
| Permendur | 8.30 | 3.5 (42.2%) | 3.7 (44.6%) | 4.5 (54.2%) |

TABLE 1-continued

| Sample | True density g/cm$^3$ | Tap density before treatment g/cm$^3$ (Tap density ratio) | Tap density after treatment without collision target g/cm$^3$ (Tap density ratio) | Tap density after treatment with collision target g/cm$^3$ (Tap density ratio) |
|---|---|---|---|---|
| High speed steel M2 | 8.18 | 3.3 (40.3%) | 3.5 (42.8%) | 4.1 (50.1%) |

As is apparent from Table 1, the samples treated using a collision target showed higher tap density ratios than those treated without using the collision target, i.e., 6.2%, 9.6% and 7.3% higher tap density ratios for stainless steel (AISI 316), Permendur and high speed steel (M2), respectively, and the use of a collision target is effective in achieving an improved tap density.

Among the above sample powders, three kinds of powders of stainless steel AISI 316 (i.e. the untreated powder, the powder treated without using the collision target and the powder treated using the collision target) were examined for injection-moldability as follows. 91% by weight of each powder was blended with an organic binder consisting of 4.5% by weight of polyethylene, 3.7% by weight of paraffin wax and 0.8% by weight of stearic acid. 6 g of each of the resultant powder mixtures was charged into a flow tester made by Shimazu Seisakusho and subjected to an injection moldability test (flow test) at 170° C. under a load of 10 kgf, using a die of 1.0 mm in diameter and 1.0 mm in length. The injection pressure was 20 kgf. The test results are shown in Table 2.

TABLE 2

| Stainless steel AISI 316 | Tap density g/cm$^3$ (Tap density ratio) | Injection moldability (ml/sec) |
|---|---|---|
| Before treatment | 3.6 (44.8%) | $5.8 \times 10^{-2}$ |
| After treatment without collision target | 3.8 (47.3%) | $1.1 \times 10^{-1}$ |
| After treatment with collision target | 4.3 (53.5%) | $2.3 \times 10^{0}$ |

As is apparent from Table 2, the injection-moldability of the sample treated without using the collision target was 1.9 times that of the untreated sample, while the injection-moldability of the sample treated using the collision target was 39.7 times that of the untreated sample. That is, when water-atomized powder is treated by a high-speed gas using a collision target, the injection-moldability of the resultant treated powder is improved to approximately 40 times that before treating. Further, it is understood that the use of a collision target results in a substantial improvement in the injection-moldability to a level about 21 times the injection-moldability without using a collision target.

Further, the stainless steel AISI 316 powder obtained by the high-speed gas treatment using the collision target according to the present invention was injection-molded and debound. The thus obtained debound body was examined for defects (blistering and cracking) in order to compare with the water-atomized powder before the high-speed gas treatment and a conventional gas-atomized powder of the same stainless steel. The results are shown in Table 3.

TABLE 3

| Tap density (g/cm$^3$) | Organic binder blending proportion (wt %) | Injection moldability | Debinding time (hr) | Percent defective of debound body (%) | Cause of defect: Blistering | Cause of defect: Cracking |
|---|---|---|---|---|---|---|
| Powder of the present invention | | | | | | |
| 4.3 | 8 | good | 24 | 0 | 0 | 0 |
| Comparative powders | | | | | | |
| Water-atomized powder before treatment | | | | | | |
| 3.6 | 8 | unacceptable | — | — | — | — |
| 3.6 | 10 | good | 36 | 32 | 32 | 0 |
| Gas-atomized powder | | | | | | |
| 4.8 | 8 | qood | 24 | 27 | 0 | 27 |

In the case of the water-atomized powder before the treatment, when the blending proportion of an organic binder was increased to 10% by weight from 8% by weight, the injection-moldability was improved but the debound bodies showed a percent defective as high as 32%. Whereas the inventive powder showed a superior injection-moldability equal to that of the gas-atomized powder. Regarding the percent defective, the inventive powder showed a percent defective of 0%, whereas the gas-atomized powder showed a very high percent defective of 27% as compared with the inventive powder.

Figure 2:
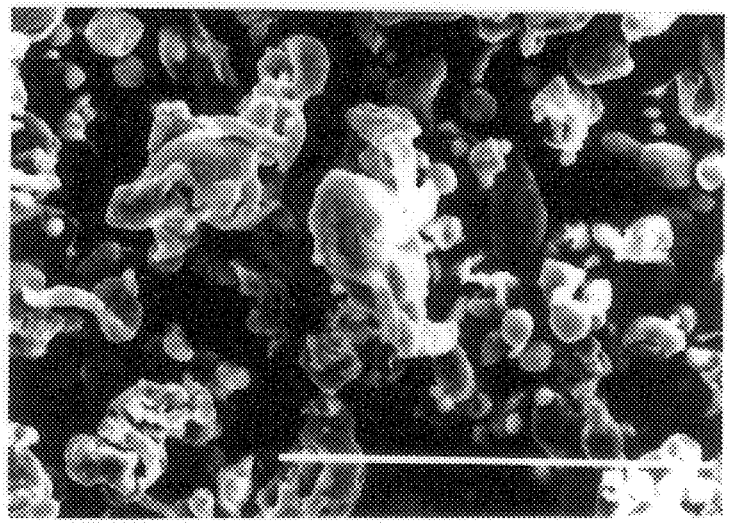
FIG. 2 is a scanning electron micrograph of the water-atomized powder before the high-speed gas treatment.

FIG. 2 is a scanning electron micrograph (×1000) showing the particle shape the AISI 316 steel water-atomized powder before the high-speed gas treatment. It can be seen from FIG. 2 that the untreated water-atomized powder is composed of non-spherical particles.

FIG. 1 is a scanning electron micrograph (×1000) of the same powder after the high-speed gas treatment using a collision target and shows that projections on the particles have been smoothed and the particles have become more spherical.

Figure 3:
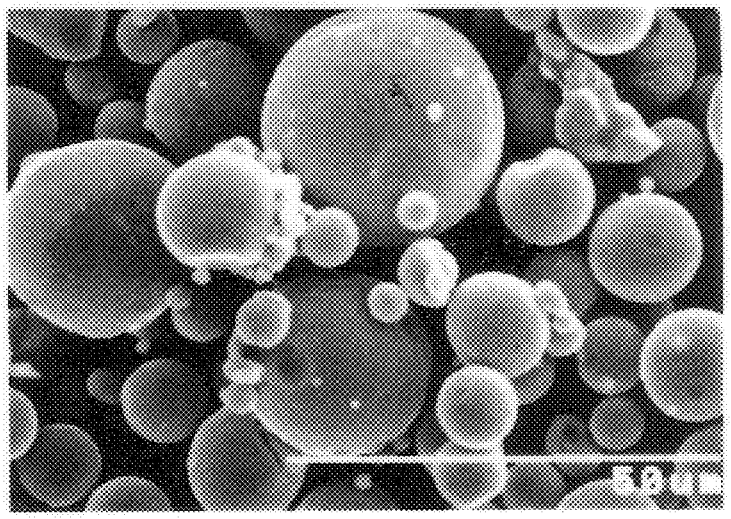
FIG. 3 is a scanning electron micrograph of a gas-atomized powder.

FIG. 3 is a scanning electron micrograph (×1000) of a gas-atomized powder consisting of perfectly spherical particles.

This invention produces a water-atomized metal powder wherein there are few particles of non-spherical shape, the particles being effectively spherical so that the blending proportion of organic binder used in injection molding can be reduced compared to the proportion used in a conventional water-atomized powder and the injection-moldability and tap density are improved while the strength of the resulting debound body is ensured. Moreover, the metal powder of the invention can be produced by a simple method. The strength of the debound body is fully maintained due to the fact that the particles of this powder are not as perfectly spherical as in the case of a gas-atomized powder, and still retain some degree of irregularity.

What is claimed is:

1. A water-atomized metal powder having a spherical particle shape, an average particle size of 10–25 microns and a tap density ratio of 50–60%.

2. A method for producing water-atomized spherical metal powder, the method comprising forming metal particles of non-spherical shapes from molten metal by water-atomization, and subjecting the metal particles to a high speed gas stream to cause high speed collisions to occur between said particles and between said particles and a collision target to form spherical particles having an average particle size no greater than 25 $\mu$m and a tap density ratio of from 50–60%.

3. The water-atomized metal powder of claim 1, wherein the tap density ratio is from 50–54.2%.

4. The method of claim 2, wherein the tap density ratio is from 50–54.2%.

5. The method of claim 2, wherein the average particle size is from 10–25 microns.

* * * * *